United States Patent [19]

Milianowicz

[11] 4,000,387

[45] Dec. 28, 1976

[54] PUFFER-TYPE GAS CIRCUIT-INTERRUPTER

[75] Inventor: Stanislaw A. Milianowicz, Monroeville, Pa.

[73] Assignee: Westinghouse Electric Corporation, Pittsburgh, Pa.

[22] Filed: May 13, 1974

[21] Appl. No.: 469,586

[52] U.S. Cl. ..... 200/148 A; 200/150 G; 200/153 B; 200/153 SC

[51] Int. Cl.[2] ..... H01H 33/88

[58] Field of Search ..... 200/148 R, 148 A, 148 B, 200/148 G, 150 G, 153 SC, 153 B

[56] References Cited

UNITED STATES PATENTS

| | | | |
|---|---|---|---|
| 2,757,261 | 7/1956 | Lingal et al. | 200/148 B |
| 2,933,575 | 4/1960 | Baker | 200/148 A |
| 3,527,912 | 9/1970 | Jaillet | 200/148 A |
| 3,674,956 | 7/1972 | Erni | 200/148 A |
| 3,739,125 | 6/1973 | Noeske | 200/148 A |
| 3,786,215 | 1/1974 | Mauthe | 200/148 A |
| 3,801,763 | 4/1974 | Marin | 200/146 R |
| 3,824,360 | 7/1974 | Slamecka et al. | 200/148 A |

FOREIGN PATENTS OR APPLICATIONS

| | | | |
|---|---|---|---|
| 1,019,819 | 2/1966 | United Kingdom | 200/148 A |

*Primary Examiner*—Robert S. Macon
*Attorney, Agent, or Firm*—W. R. Crout

[57] ABSTRACT

An improved puffer-type compressed-gas circuit-interrupter is provided having tubular stationary and movable contacts, which make a valve-closed, gas-retaining, abutting, contacting action for a predetermined portion of the opening travel of the interrupter.

A lazy-tong-multiplying operator is provided with the guide-rail means therefor supported from one end of a gas-retaining hollow casing structure. Additionally, a movable metallic cooler member is shielded by the movable nozzle movable with the movable operating gas-compressing cylinder.

4 Claims, 25 Drawing Figures

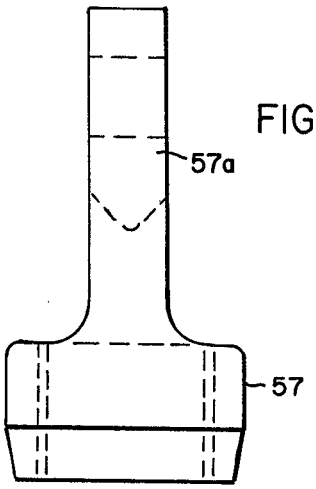
FIG. 12
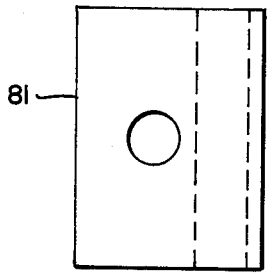
FIG. 14
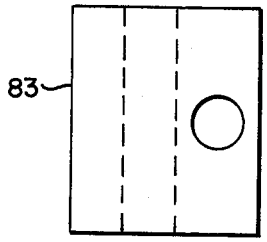
FIG. 15
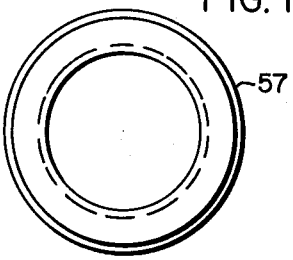
FIG. 13
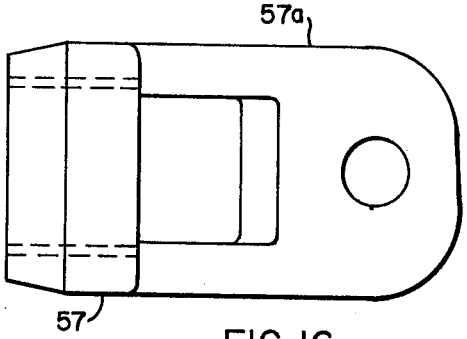
FIG. 16
FIG. 25
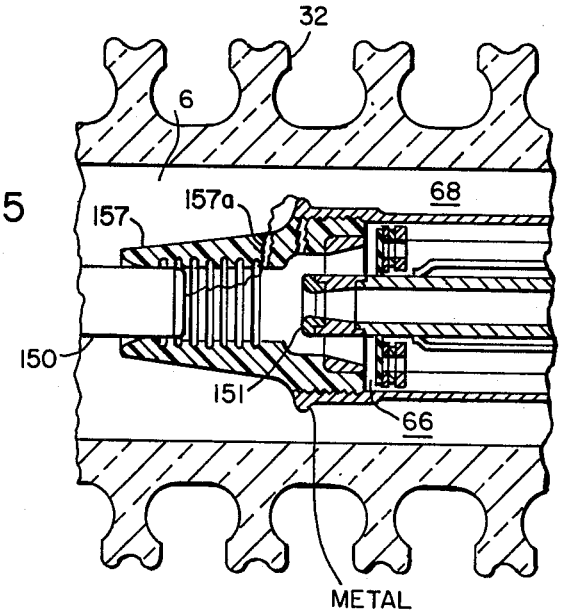

PUFFER-TYPE GAS CIRCUIT-INTERRUPTER

CROSS-REFERENCE TO RELATED APPLICATIONS

Reference may be had to the following patent applications: U.S. Patent Application filed May 3, 1974, Ser. No. 466,745, now U.S. Pat. No. 3,932,715, issued Jan. 13, 1976 to Steven Swencki and Stanislaw A. Milianowicz; U.S. patent Application filed July 31, 1967, Ser. No. 657,122, now U.S. Pat. No. 3,588,407, issued June 29, 1971 to Steven Swencki and Stanislaw A. Milianowicz, all of the foregoing patent applications being assigned to the assignee of the instant patent application.

Also, patent application filed Sept. 11, 1973, Ser. No. 396,163, by Russell E. Frink and now U.S. Pat. 3,875,355, issued Apr. 1, 1975 to Stanislaw A. Millianowicz covers an improved corrision-resistant contact hinge-structure related to the hinge end of the movable disconnecting switchblade when a disconnecting switch is utilized with the interrupter device of the present invention.

Moreover, U.S. patent application filed May 14, 1974, Ser. No. 469,932, now U.S. Pat. No. 3,943,314, issued Mar. 9, 1976 to Russell E. Frink, relates to a lazy-tong, or pantograph type of operating mechanism, and an improved operating seal for a sealed-type of interrupter unit or casing, which provides a considerably lengthened movable contact travel distance with a relatively short minimal axial initiating operating movement of the connecting rod, which initiates movement of the lazy-tong linkage, for example, from the externally located operating mechanism.

Also, U.S. patent Application filed May 8, 1974, Ser. No. 468,332, by Russell E. Frink et al. covers a shunt-trip accelerating device, and filed U.S. patent application filed May 14, 1974 Ser. No. 469,931 by Russell E. Frink et al. relates to an improved operating mechanism for the switch.

BACKGROUND OF THE INVENTION

Puffer-type circuit-interrupters utilizing a movable operating-cylinder, carrying a nozzle structure and a movable contact structure, and sliding over a relatively fixed piston member are well known in the art. Reference may be had to U.S. Pat. No. 2,757,261, issued July 31, 1956, to Lingal et al, and also to U.S. Pat. No. 2,788,418, issued Apr. 9, 1957, to Owens et al. Additional interrupting structures are set forth in U.S. Pat. No. 3,588,407, issued June 28, 1971 to Frink et al., the latter patent illustrating a movable piston member carried by an operating cylinder, and sliding over a fixed orifice member to inject compressed gas into a pair of separable tubular venting contacts. Valve action provided between two vented contacts separable to establish arcing is shown in Frink et al. U.S. Pat. No. 3,588,407 issued June 28, 1971 and Leeds U.S. Pat. No. 3,769,479 issued Oct. 30, 1973.

It is desired in the present application to effect certain interrupting improvements in puffer-type interruption of the present invention over the puffer-type circuit-interrupters of the foregoing patents and the prior art to enable them to more effectively and quickly interrupt high-magnitude charging and magnetizing currents at high voltages, while at the same time not requiring additional series breaks in the circuit.

SUMMARY OF THE INVENTION

In accordance with the present invention, there is provided a movable operating cylinder preferably wholly composed of insulating material at its forward end, and carrying a gas-flow hollow guiding orifice member therewith and also the hollow movable venting contact structure, the entire movable assembly sliding over a relatively stationary fixed piston member, the latter being supported from one end of the enclosing interrupter-casing structure. The construction is such that the movable operating cylinder and the hollow orifice member, being composed preferably entirely of insulating material, provide a desirable insulating shield, or shroud, entirely enclosing the internally-disposed metallic contact members at high voltage from the ambient outside of the moving contact assembly and interiorly of the outer enclosing insulating casing structure.

The advantage results that the dielectric strength of the relatively highly-compressed gas, interiorly of the operating cylinder, is much greater than the delectric strength of the relatively low-pressure gas on the outside of the operating-cylinder assembly. As a consequence, electrical field conditions are improved, and there is less likelihood of voltage breakdown occurring through the hollow insulating nozzle; and no component pieces of metal, associated with the movable operating cylinder, are exposed to the relatively low-pressure gas conditions present externally of the movable operating-cylinder assembly, yet internally of the surrounding enclosing casing structure where the dielectric strength of the gas is relatively low because of the low-pressure conditions present.

According to the present invention, preferably the use of external metallic parts, of whatsoever kind, are completely eliminated externally of the movable operating cylinder to be exposed to the ambient externally of the moving contact assembly, and consequently there is no possibility of voltage breakdown through the hollow insulating movable nozzle, as has been the case in prior-art puffer interrupter constructions, where either the movable operating cylinder, or component parts movable therewith, were composed of metallic material.

According to a further important object of the present invention, an improved movable operating-cylinder construction is provided, carrying therewith a movable hollow gas-flow nozzle and the movable hollow vented contact structure, the latter being cooperable with a relatively-stationary hollow vented contact structure, which has a lost-motion following travel with the movable hollow vented contact structure, the two vented contacts preferably being in abutment, so that a desired valve-action there-between is achieved. Accordingly, during the opening operation, a desirable precompression of the gas occurs within the movable operating-cylinder compression-chamber, while the cooperable venting contacts make a valve-action abutment relation during the initial portion of the opening operation prior to contact part.

Consequently, upon the take-up of the lost-motion action associated with the relatively-stationary hollow vented contact structure, the two separable venting contacts part to establish arcing, and at this same point in time, the desirable precompression of the gas within the movable operating cylinder has been attained, so that immediately upon contact part there occurs a desirable high-pressure gas-flow across the established arc and out through the hollow movable nozzle to effect rapid extinction of the arc.

BRIEF DESCRIPTION OF THE DRAWINGS

FIG. 12 is a side elevational view of a moving rod-end member;

FIG. 13 is an end elevational view of the rod-end member of FIG. 12;

FIGS. 14 and 15 are side-elevational views of metallic mounting blocks used in my improved construction;

FIG. 16 is a side-elevational view of another rod-end member;

DESCRIPTION OF THE PREFERRED EMBODIMENTS

Modern circuit-breakers are efficient and reliable devices and perform their duties adequately. However, they are large and expensive; and in many cases, economies can be achieved with less-expensive devices. Such devices have been available for several years and range from load-interrupter switches, with interrupting ratings approximating their continuous current-carrying capabilities, to devices which can interrupt a few thousand amperes with modest transient-recovery capabilities.

Over the past few years, development work performed with $SF_6$ gas puffer-type circuit-interrupters has led to improvements in these gas-type devices. Some of these improvements have been incorporated into the medium-fault-interrupting class devices, such as set forth in the instant patent application, thus expanding their field of application. Some of the advantages attained by the invention set forth herein include:

a. Simplicity of construction;
b. 10,000 amperes interrupting capacity at 169 KV, for example, on a single-break interrupter without using shunt capacitors or resistors;
c. Transient-recovery capability on busfaults corresponding to capability of circuit-breakers at maximum rating;
d. Full insulation strength across the open contacts of the interrupter without requiring an open disconnecting switch;
e. High-speed circuit-making and breaking in pressurized $SF_6$ gas which eliminates any arcing in air; and
f. Low noise level during switch operation.

Figure 1:
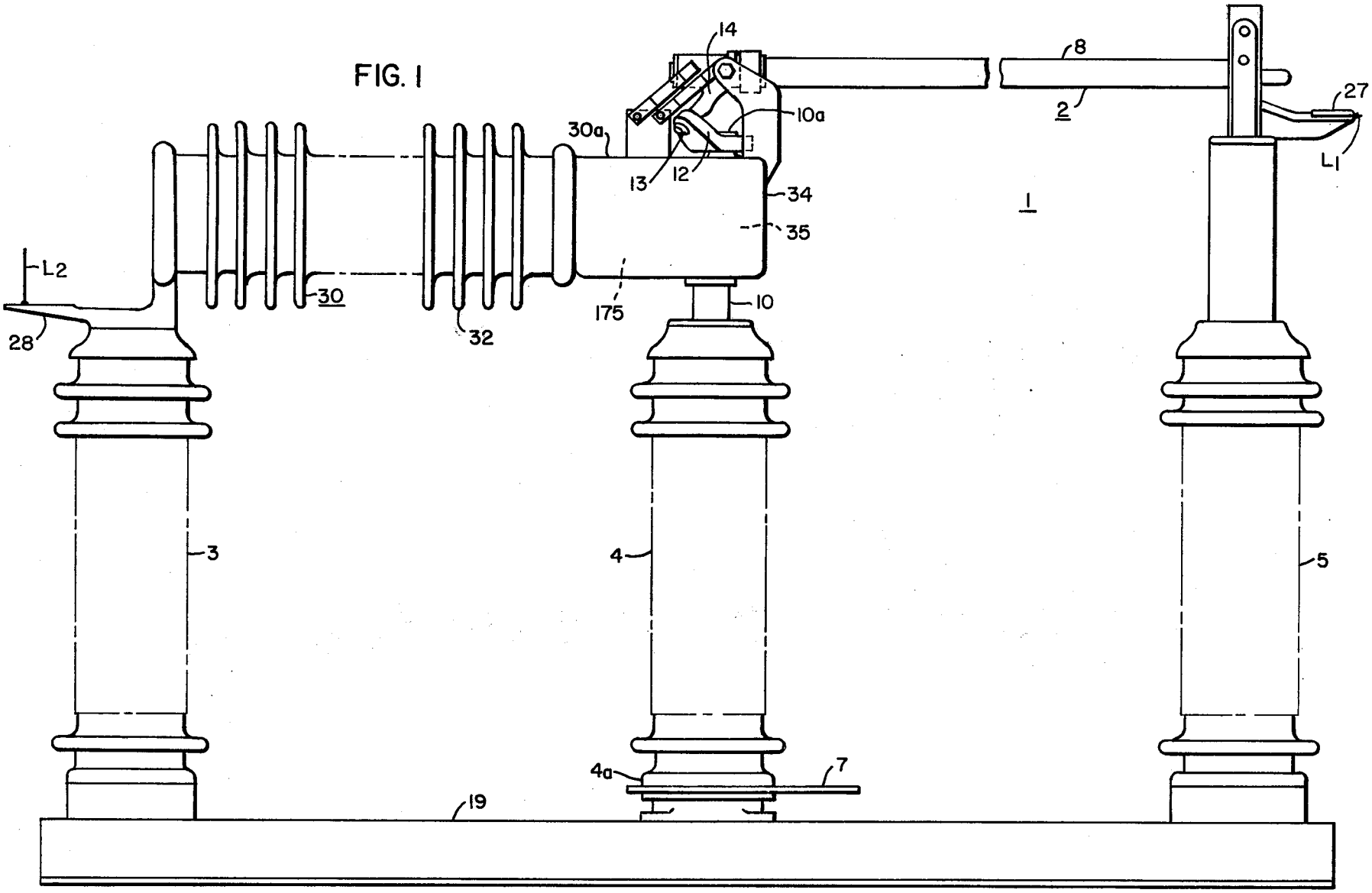
FIG. 1 is a side-elevational view of one pole-unit of a three-phase circuit-interrupting assemblage, having a serially-related disconnecting switchblade, utilizing the principles of the present invention, the device being shown in the closed-circuit position.

Referring to the drawings, and more particularly to FIG. 1 thereof, the reference numeral 1 generally designates a circuit-interrupting structure including three upstanding post insulators 3, 4 and 5. The two end post insulators 3 and 5 are stationary, whereas the middle post insulator 4 is rotatable, being driven from its lower end by an operating-crank 7 connected to any suitable operating mechanism. Such an operator may be a motor-driven device, or in certain instances the crank-operator 7 may be manually driven.

In more detail, the operating mechanism not shown, which may be of any suitable type, effects rotation of a vertically-extending operating shaft 10, to the upper end of which 10*a* (FIG. 1) is affixed to rotatable crank-arm 12. To the outer free end of the crank-arm 12 is pivotally connected, as at 13, an actuator 14 which effects swinging opening and closing motions of a disconnecting switchblade 8.

Figure 2:
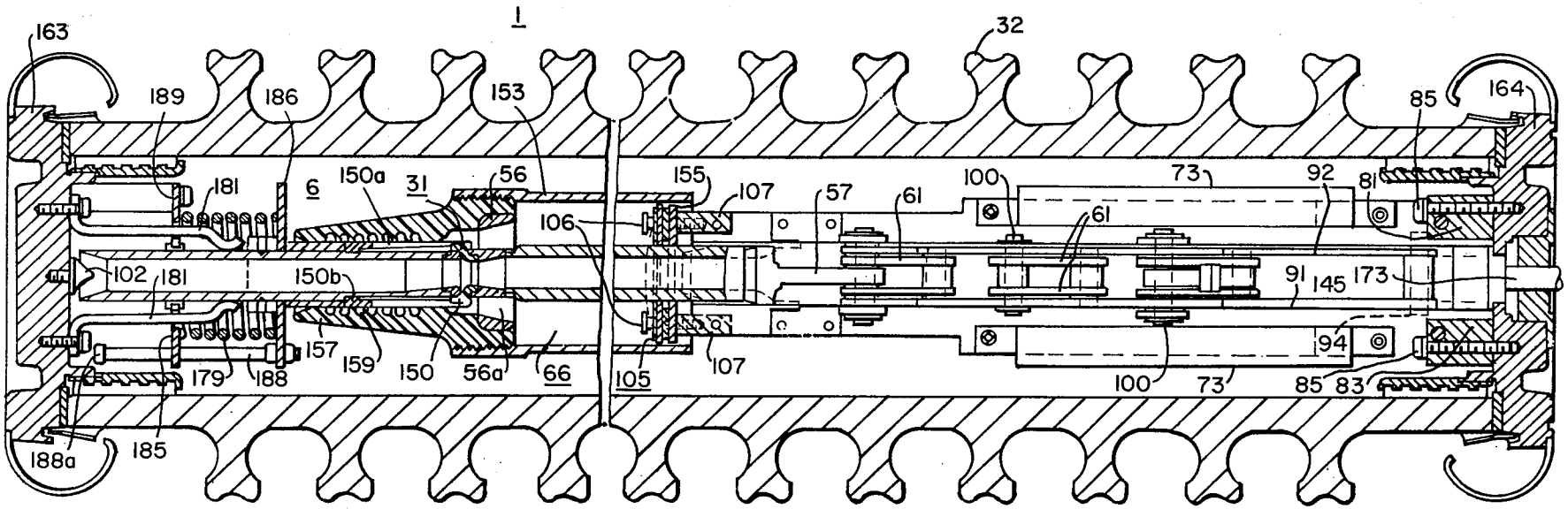
FIG. 2 is an enlarged longitudinal sectional view taken axially through the circuit-interrupter unit of FIG. 1 extending between the two upstanding column structures of FIG. 1 the separable contact structure and disconnecting blade being illustrated in the closed-circuit position.
Figure 3:
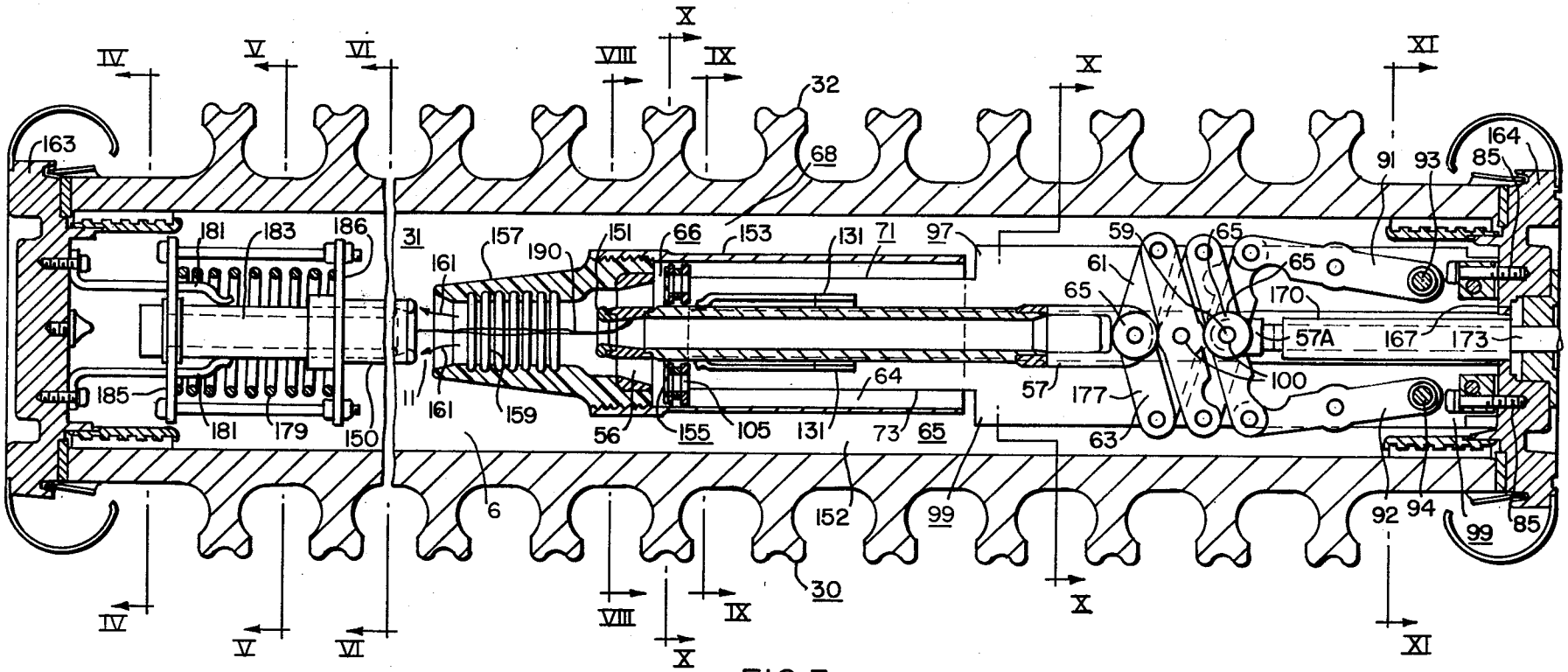
FIG. 3 is a longitudinal sectional view taken at right angles to that of FIG. 2, but illustrating the disposition of the several contact parts in the fully-open-circuit position of the circuit-interrupter, but for illustrative purposes, the gas-flow being indicated by directional arrows within the movable gas-nozzle structure, and the location of the established arc being indicated in FIG. 3.

Extending between each end post insulator 3 of a three-phase circuit-interrupted and the middle rotatable driving post insulator 4 of each single-phase interrupter is the improved puffer-type interrupting assembly, or a circuit-interruptor 30, (FIGS. 2 and 3) of my invention which encloses one or more serially-related separable contact structures 31 (FIG. 3) of the gas-puffer type of circuit-breaker, as set forth in FIGS. 2 and 3 of the drawings, which may, for example, use sulfur-hexafluoride ($SF_6$) gas 6.

Referring again to the drawings, and more particularly to FIG. 1 thereof, it will be observed that one application of the present invention is in connection with a circuit-interrupting device 30 having a serially-related disconnecting switchblade 8 associated therewith for obvious safety reasons. Those skilled in the art may call such a structure a "load-break disconnecting switch", in which the circuit-interrupting structure 30 is utilized to actually break the load-current passing through the device 1, and the function of the disconnecting switchblade 8 itself is merely to effect a visible open-circuit condition of the device 1, so that maintenance people may work upon the connected electrical line U, L2 without fear of high-voltage shock occurring.

With reference to FIG. 1, it will be observed that extending upwardly from the elongated base support 19, which may be of generally tubular configuration, if desired, are stationary insulating columns 3 and 5, which support a right-hand line-terminal 27 and a left-hand load-terminal 28, with a circuit-interrupting assemblage 30 enclosed with a hermetically-sealed housing 32 extending between the load-terminal 28 and a generally box-shaped metallic mechanism housing 34, which has a mechanism 35 disposed therewithin. Electrically interconnecting the metallic mechanism housing 34 and the line-terminal 27 is a swinging disconnecting switchblade 8, which provides an open-circuit visible gap between the line-terminal 27 and the mechanism housing 34 in the fully open-circuit position of the circuit-interrupter 30.

It will be observed that the end insulating columns 3 and 5 are stationary, merely providing a supporting function, whereas the middle insulating column 4 is rotatable, and has an operating function, having an upper extending shaft-portion 10*a*, which extends interiorly within the mechanism housing 34, and serves to actuate the operating mechanism 35 provided therein. The upstanding operating shaft 10*a* extends, moreover, upwardly through the mechanism housing 34, terminating in a crank-arm 12 (FIG. 1), and actuates the opening swinging motion of the disconnecting switchblade 8. In other words, the upper end of the operating shaft 10 effects rotative opening and closing movements of a crank-arm 12, which, in turn, effects rotation and swinging opening and closing motions of the serially-related disconnecting switchblade 8.

With reference to FIGS. 2 and 3 of the drawings, it will be observed that the separate contact structure 31 comprises a spring-biased stationary contact 150 and a movable tubular contact structure 151, which carries an operating cylinder 153 over a relatively stationary piston structure 155. In addition, the movable tubular contact 151 carries an orifice structure 157 having a corrugated opening 159 therethrough, through which gas 6, such as sulfur-hexafluoride ($SF_6$) gas, for example, is forced during the opening gas-moving motion of the operating cylinder 153 over the stationary piston structure 155 to thus force the gas to flow in the direction indicated by the arrows 161 in FIG. 3.

Generally, the circuit-interrupting assemblage 30 includes a longitudinally-extending casing 32 of insulating material having sealed to the ends thereof metallic end-cap casting structures 163, 164. The left-hand metallic end-cap structure 163 is electrically connected to the left-hand load-terminal 28 of the switch structure, 1. The right-hand metallic end-cap structure 164 has an opening 167 extending therethrough, which accommodates a metallic sylphon bellows 170 and a metallic operating rod 173. One end of the metallic sylphon bellows 170 is sealed to the inner face of the opening 167 of the metallic end-cap structure 164. The other, or left-hand end of the metallic sylphon bellows 170 is secured in sealing relationship to the movable metallic contact operating rod 173, which extends into the mechanism compartment 34, (FIG. 1) and is actuated by the operating mechanism 35, constituting no portion of the present invention. This mechanism is described in United States Patent Application filed May 14, 1974, Ser. No. 469,931 by Russell E. Frink and Stanislaw A. Milianowicz, and assigned to the assignee of the present application.

In the closed-circuit position of the device, shown in FIG. 2, the lazy-tong linkage mechanism 177 is somewhat extended, and forces the movable tubular contact 151 into closed contacting engagement with the stationary tubular contact 150, and somewhat compressing the contact-compression spring 179. Relatively stationary contact fingers 181 slide upon the supporting cylinder 183, which carries the relatively stationary contact 150 at its right-hand end in the manner illustrated in FIG. 3 of the drawings.

Figure 4:
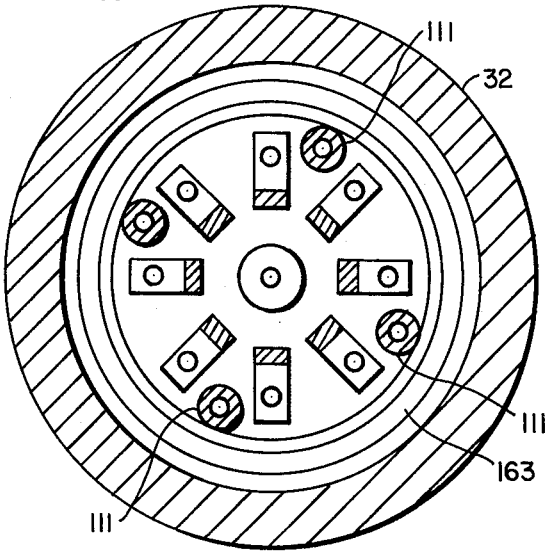
FIG. 4 is a sectional view taken substantially along the line IV—IV of FIG. 3.
Figure 5:
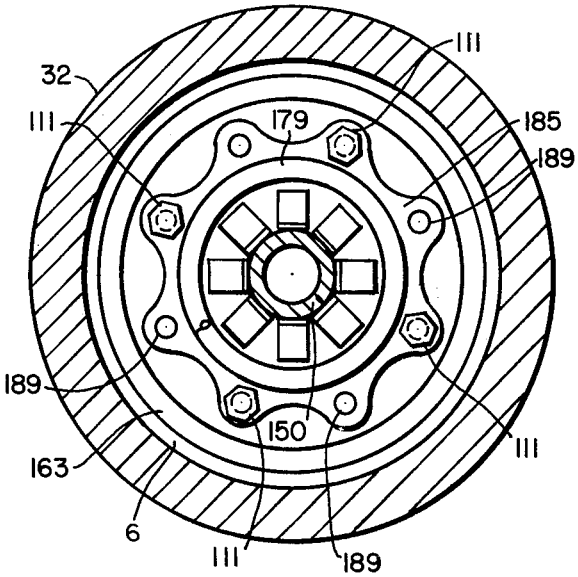
FIG. 5 is a sectional view taken substantially along the line V—V of FIG. 3.
Figure 6:
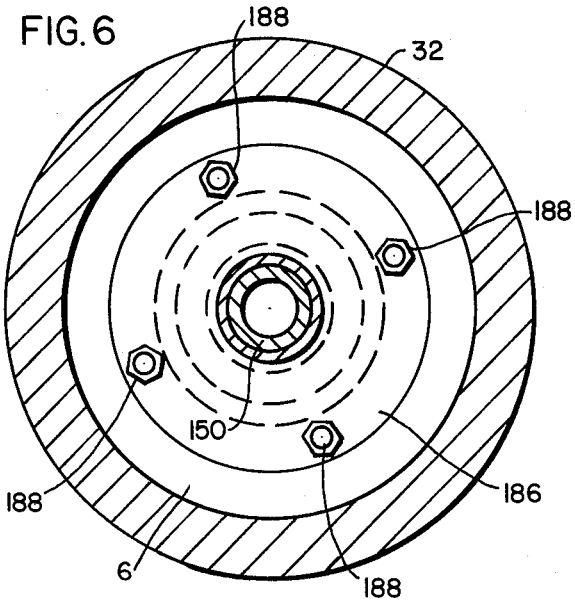
FIG. 6 is a sectional view taken substantially along the line VI—VI of FIG. 3.
Figure 7:
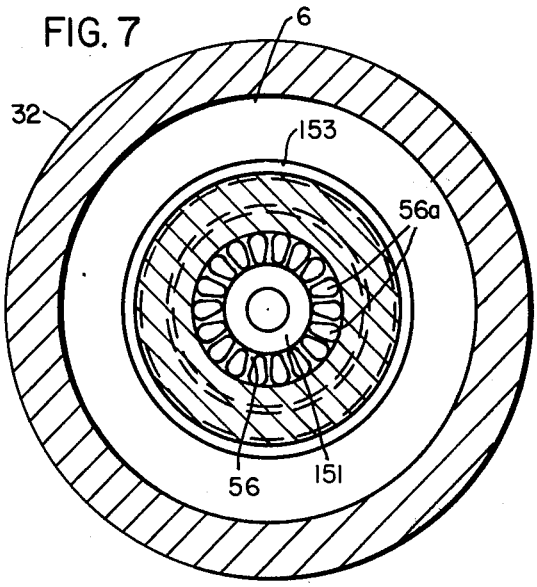
FIG. 7 is a sectional view taken substantially along the line VII—VII of FIG. 3.

A support plate 185 (FIG. 5) is fixedly supported by post-means 111 (FIG. 4) from the left-hand metallic end-cap structure 163, and the contact-compression spring 179 seats thereon. The right-hand end of the contact compression spring 179 seats upon a movable spring seat 186 (FIG. 6), which is affixed to a plurality of spring-rods 188, which are capable of sliding through openings 189 provided in the stationary spring seat 185 (FIG. 5).

As will be obvious from an inspection of the interrupter 30 of FIGS. 2 and 3, extension of the lazy-tong linkage 177 brings the tubular contacts 150, 151 into closed contacting engagement, as shown in FIG. 2, to close the electrical circuit through the device 30, whereas retraction of the lazy-tong linkage 177, as caused by righward movement of the operating rod 173 driven from the mechanism 35, will effect opening of the separable tubular venting contact structure 150, 151 with concomitant piston-driving gas-flow 152 action through the tubular hollow orifice 157 to effect extinction of the arc 190, which is established between the contacts, as shown in FIG. 3.

Although FIG. 3 shows the fully open-circuit position of the tubular venting contact structure 31, nevertheless for purposes of clarity, the position of the arc 190 has been indicated in FIG. 3 to show that it is acted upon by the gas-flow forced in the direction of the arrows 161 by the movable insulating operating cylinder 153 sliding longitudinally over the stationary piston structure 155.

It will be observed that the relatively stationary contact assembly 150 comprises a surrounding slotted contactsleeve portion 150*a*, which is secured, as by brazing, to an intermediate portion of the tubular relatively stationary contact, as at 150*b*. The support plate 189 also, of course, serves as a spring seat for the contact-biasing spring 179, as shown in FIGS. 2 and 3 of the drawings. To deflect the gas-flow through the relatively stationary contact, preferably a deflector button 102 is secured in the left-hand metallic end plate 163 of the circuit-interrupter, as shown in FIGS. 2 and 3.

Preferably, a metallic cooler assembly 56 is provided affixed to, and movable with the tubular movable venting contact 151. The metallic cooler 56 is provided by an annular metallic member having a plurality of circumferential holes 56*a* provided therethrough to cool the compressed gases entering the arcing region 11. The cooler assembly 56 is affixed, as by brazing, for example, to the external surface of the movable tubular venting contact 151 and is surrounded by the insulating nozzle structure 157. Externally of the nozzle structure 157, as more clearly illustrated in FIG. 3, is the insulating operating cylinder 153, which moves with the nozzle 157 and movable tubular venting contact 151, as a unitary assembly, during the opening operation.

Figure 10:
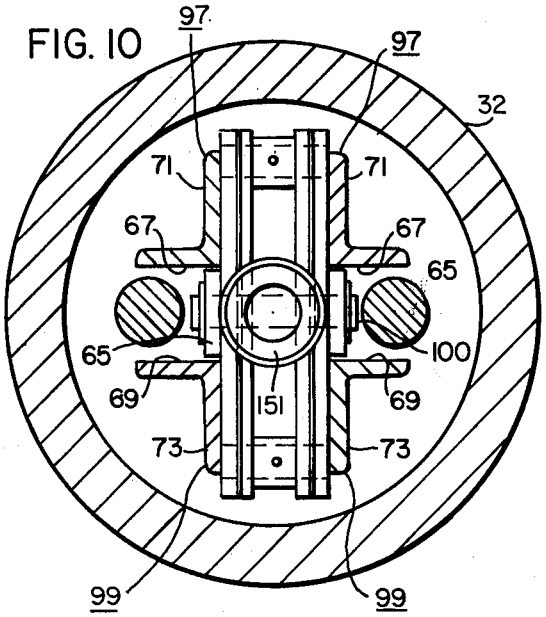
FIG. 10 is a sectional view taken substantially along the line X—X of FIG. 3.

The right-hand end of the movable tubular venting contact 151 is fixedly secured, as by a threaded connection, to a rod-end member 57, more clearly illustrated in FIGS. 12, 13 and 16 of the drawings. The rod-end member 57 has an apertured extension 57*a* integrally provided therewith, which is secured, as by a pivot-pin 59, to the left-hand end of a lazy-tong assembly, or pantograph assembly 177, comprising a plurality of interconnected pivoted links 61, 63, and guided by a plurality of roller members 65, which move along the opposing confronting flange-portions 67, 69 of the guide-angle members 71, 73 (FIG. 10). The right-hand ends of the guide-angle members 71, 73 are secured to a plurality of metallic mounting blocks 81, 83 which, in turn, are secured by mounting bolts 85 to the right-hand metallic end plate 164 of the interrupter assembly 30, as shown in FIG. 3.

Figure 11:
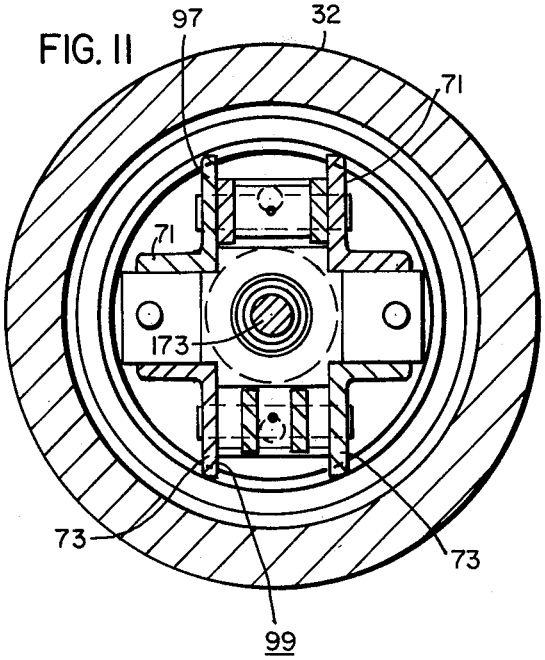
FIG. 11 is a sectional view taken substantially along the line XI—XI of FIG. 3.
Figure 19:
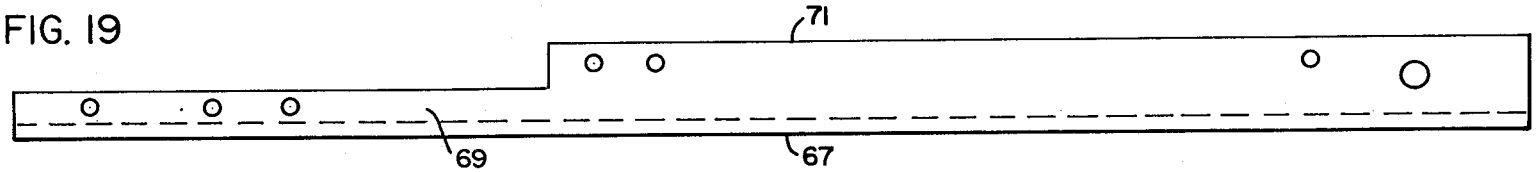
FIG. 19 is a top plan view of the guide-angle member of FIG. 17.
Figure 17:
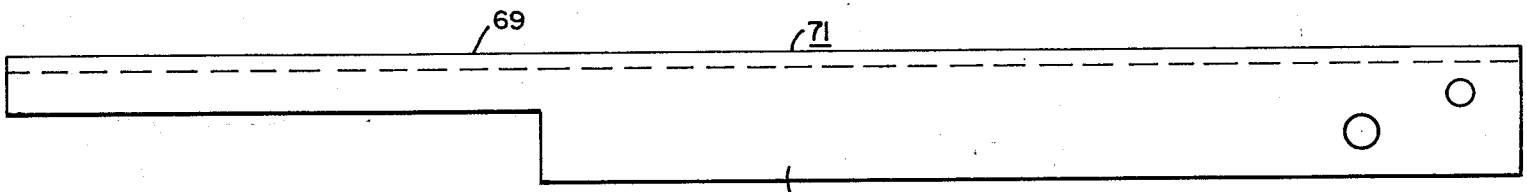
FIGS. 17 and 18 are, respectively, side-elevational and end views of metallic guide-angle members utilized in the improved interrupter construction for guiding the axial movement of the lazy-tong linkage.
Figure 23:
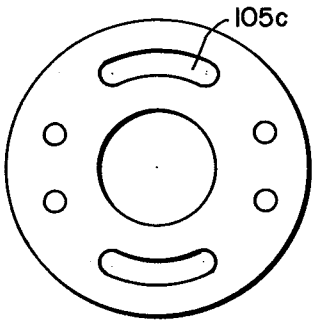
FIGS. 23 and 24 are additional views of component parts of the valve structure; and, FIG. 25 illustrates a typical prior-art nozzle construction using metallic component parts, associated with the movable operating-cylinder construction, and indicating the electrical voltage breakdown paths through the breakdown holes resulting in the movable insulating gas-flow nozzle as a result of the existence of poor electrical field stress conditions.
Figure 24:
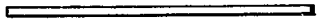
Figure 20:
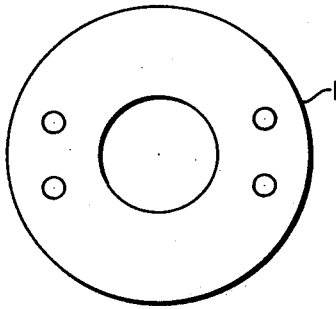
FIGS. 20, 21 and 22 are top plan and side views of the spring-washer construction associated with the valve member mounted on the fixed piston.
Figure 21:
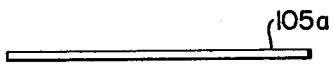
Figure 22:
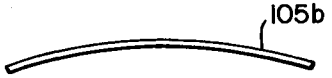
Figure 18:
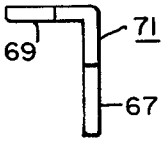

The right-hand end of the lazy-tong, or pantograph assembly 177 includes two pairs of guide links 91, 92, the right-hand ends of which are stationarily pivotally secured, as by two stationary pivot pins 93, 94 to the upper and lower pairs of angle-standards 97, 99 which additionally provide confronting flanged surfaces to guide pairs of guide rollers 65 associated with the pivot-pin connections 100 of the several links 61, 63 constituting the lazy-tong assemblage 177. This construction is more clearly illustrated in FIGS. 10 and 11, wherein it will be observed that the guide-rollers 65 are spaced laterally apart, being provided on the same movable pivot pins 100, and each movable guide-roller 65 being guided between the flanged surfaces 67, 69 of a pair of the angle-standards 97 or 99.

The left-hand ends of the four stationary angle-standards are reduced in width to accommodate the longitudinal travel of the insulating operating cylinder 153, as more clearly illustrated in FIG. 3.

To effect the longitudinal extension and contraction of the lazy-tong assemblage 177, the contact operating rod has a rod-end 57A, which is pivotally connected to the first pivot point of the lazy-tong assemblage, as indicated by the reference numeral 59. Since the two pairs of guide-links 91, 92 are stationarily pivoted at the points 93, 94, the inward and outward movement of the contact-operating rod-end 57A will effect outward extension and inward contraction of the lazy-tong assemblage 177 in an obvious manner. The pivoted links 61, 63 themselves will, of course, be guided by the lateral confronting flange surfaces 67, 69 of the two pairs of angle-standards 97, 99 in a manner more clearly illustrated in FIG. 10.

The fixed piston assembly 155 is fixedly secured to the left-hand ends of the metallic angle-standards 97, 99 in a manner more clearly illustrated in FIG. 3. A one-way acting valve structure 105 is associated with the fixed piston structure 155, so that during the compressing operation, the valve structure 105 closes, whereas during the contact closing operation, the valve structure 105 will then open to permit gas flow from the ambient 64 within the casing 32 to flow into the compression region 66 within the operating cylinder member 153.

The left-hand end of the lazy-tong assemblage 177 has a thrust member 57, which is fixedly secured to the right-hand end of the moving hollow venting contact assembly 151. This structure is shown more clearly in FIG. 3 of the drawings.

Figure 8:
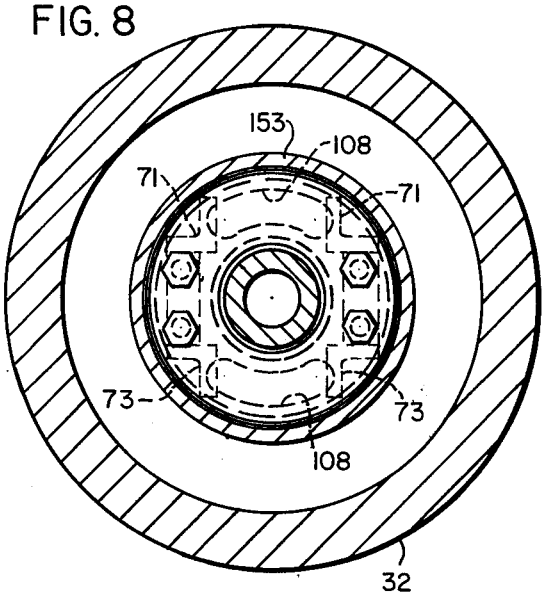
FIG. 8 is a sectional view taken substantially along the line VIII—VIII of FIG. 3.
Figure 9:
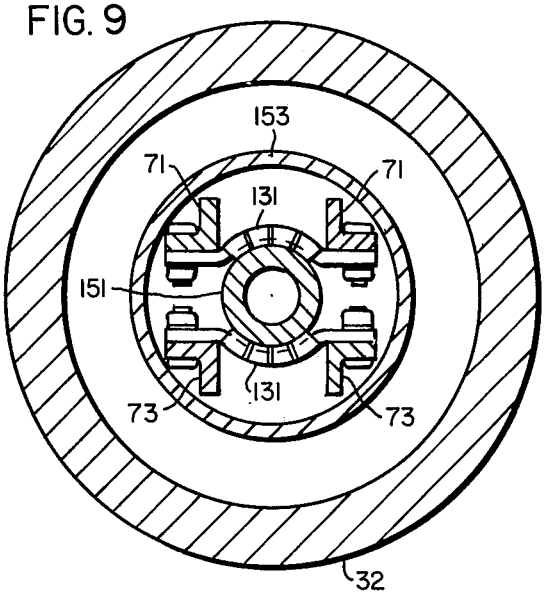
FIG. 9 is a sectional view taken substantially along the line IX—IX of FIG. 3.

The one-way acting valve structure 105 comprises an annular valve 105a and an annular valve-spring 105*b*, both being supported by four post supports 106, the latter being secured to the four mounting blocks 107. The valve-spring 105*b* normally holds the annular valve 105*a* over the valve openings, designated by the reference numeral 108 in FIGS. 3 and 8, so that during the compression stroke, the valve structure 105 remains closed. During contact closing, on the other hand, as mentioned, the gas pressure conditions will deflect the valve-spring 105*b* and enable the valve openings 108 to be opened to permit gas flow into the compression chamber 66.

The cooler assembly 56 has an important function during arcing, namely the cooling of the arcing gases, which may tend to backup into the compression chamber 66 during high instantaneous values of arcing current. On the other hand, when the instantaneous value of the arcing current decreases, to thereby lower the arcing pressure, the gas will return through the metallic cooler assembly 56, augmented by a fresh gas flow emanating from the compression chamber 66, and collectively will be forced into the arc 190 to be exhausted or vented in both directions through the relatively stationary venting contact structure 150 and also in the opposite direction through the moving venting contact structure 151, as indicated by the arrows 161.

A plurality of contact fingers 131 are provided, which bear laterally inwardly against the outer side surface of the movable tubular venting contact 151 to transmit current flow therefrom to the stationary metallic standards 71, 73, and thereby to the right-hand end plate 164 of the interrupter.

It will be noted that during the opening operation that the compressed gas will pass longitudinally through both tubular vented separable contacts 150, 151 for rapid arc extinction, with the carrying of the terminal ends of the arc 190 within the hollow tubular venting contacts 150, 151 themselves, to thereby attenuate the arc 190 and effect the extenction thereof.

By mounting the relatively stationary contact structure 50 in a resilient manner to enable a predetermined following movement of the stationary contact structure 150 with the movable contact structure 151 prior to separation therebetween, a desirable predetermined pressure-buildup is generated in compression region 66 within the puffer-operating cylinder 153, and trapped therein, by such abutting contact valve action, so that an adequate pressure-buildup is attained in compression region 66 before actual separation of the two cooperable hollow venting contacts 150, 151, and thereby release of the gas pressure built up within the puffer operating cylinder 153. When this occurs, the gas 6 is suddenly released by the separation of the two hollow venting contacts 150, 151, and this compresed gas 6 then rapidly flows through both separable stationary and movable tubular venting contacts 150, 151 to bring about quick interrupting extinguishing action exerted upon the drawn arc 190 established within the insulating hollow nozzle 157 and also within the hollow venting contacts 150, 151.

To effect a rapid opening travel of the movable hollow venting seperable contact structure and the movable operating cylinder 153, preferably, the lazy-tong motion multiplying mechanism 177 is provided interiorly of the causing structure 32, which is preferably hermetically sealed; and the operating rod 173 extends externally of the casing structure 32 through a sealed opening 145 (FIG. 2) adjacent the right-hand end 164, which supports the relatively fixed piston structure 155.

By way of retrospect, beginning with the interrupter in the closed-circuit position, as illustrated in FIG. 2, it will be observed that contraction of the lazy-tong linkage device 177 results in a rightward opening movement of the insulating operating cylinder 153 over the stationary filed piston structure 155. During this initial rightward opening movement of the movable tubular venting contact structure 151 and the insulating operating cylinder 153, there will, of course, be a following take-up of the lost-motion travel of the relatively stationary hollow venting contact 150 by virtue of the contactcompression spring 179 and the spring rods 188, until the heads 188a on the spring-rods 188 come into contact with the stationary support plate 185 as shown in FIG. 3. At this point in time, the following movement of the relatively stationary venting contact 150 ceases, and thereafter an arc 190 is established between the two tubular venting contacts 150, 151, the movable hollow venting contact 151 thereafter continuing its opening motion toward the right as viewed in FIGS. 1 and 3.

It will be observed that during this initial following travel of the relatively stationary hollow venting contact 150, a desirable precompression of the gas occurs within the region 66 within the movable operating cylinder 153. At the time of contact separation, this desirable precompression of the gas exists in compression region 66, and at this point in time gas flow occurs through both of the tubular contacts 150, 151 now separated, in the manner illustrated by the arrows 161 in FIG. 3.

Since the bore within both tubular contacts is of relatively equal size, there will, consequently, occur a general equalization of exhausting gas flow through both of the tubular hollow venting contacts 150, 151 in the direction indicated by the arrows 161 in FIG. 3.

A very important feature of the present invention is the efficiency and rapidity with which the arc 190 is extinguished. In more detail, from the time of actual contact part, arc extinction occurs within 1½ cycles, or less. This demonstrates adequately the efficiency of the gas-flow conditions, and the utilization of two tubular venting contacts 150, 151, one provided by the relatively-stationary contact structure itself, and the other, of course, provided by the movable tubular contact 151.

A very important feature of the operating-cylinder construction 153 of the present application is the fact that preferably it is composed entirely of insulating material adjacent its forward end, and constitutes an electrical shield, or shroud around the interiorly-disposed movable metallic contact structure 151 and metallic cooler asembly 56. It will be observed that the gas 6 on the outside of the operating cylinder 153 in the space 68 is at a relatively low pressure, say of the order to 70 to 75 p.s.i., whereas the gas within the inside of the space 66 operating cylinder 153, at the moment of arc extinction, is of a higher pressure value, say approximately of the order of 150 p.s.i. Obviously, therefore, the dielectric strength of the relatively highly-compressed gas, interiorly of the operating cylinder 153 within compression region 66, is much greater than the dielectric strength of the relatively low-pressure gas on the outside of the operating cylinder 153 in space 68.

Heretofore, using a metallic operating cylinder 153, or even utilizing metallic component parts exteriorly, or attached to the movable operating cylinder 153, led to the likelihood of voltage breakdown through the nozzle 157 itself, as indicated somewhat diagrammatically in FIG. 30. On the other hand, by entirely eliminating the use of any metallic parts, or component pieces of metal associated with the movable operating cylinder 153, so as to be exposed to the relatively low-pressure gas externally of the movable operating cylinder 153 in the region 68, this hazard of voltage breakdown is avoided.

In more detail, it will be observed that with the improved operating-cylinder construction of this invention that all metallic parts of whatsoever kind are completely eliminated externally of the operating cylinder 153, and consequently, there is no possibility of voltage breakdown through the insulating nozzle 157, as was the case set forth in FIG. 25.

Additionally, the insulating gas-flow nozzle 157, as a result of the new insulating operating-cylinder construction 153, may be of smaller radial thickness, and therefore resulting in lighter and a more economical construcion.

In the prior-art constructions, as set forth in FIG. 30, the formation of the breakdown passages at **157*a* through the nozzle is of a progressive type, and may not result in breakdown immediately, but as it develops and forms a complete hole 157*a* through the nozzle 157, electrical breakdown occurs between the electrodes on the outside of the nozzle and through the breakdown passage 157*a***.

The ratings of interrupting devices 30 incorporating the improved inventions of the present application are as follows:

| | |
|---|---|
| Rated maximum voltages | 121, 145 and 169 kV |
| Rated continuous current | 1200 A. |
| Rated symmetrical interrupting current | 10,000 A. |
| Rated TRV capability at max. int. current | 1.7 kV per $\mu$ S |
| Momentary current, RMS asymmetrical | 61,000 A. |
| 4-second current, RMS symmetrical | 40,000 A. |
| Closing current, RMS asymmetrical | 30,000 A. |
| Interrupting time (60 Hz basis) | 5 cycles |
| Contact opening speed 15.5 ft. per sec. | (4.7 m per sec.) |
| Contact closing speed 14 ft. per sec. | (4.3 m per sec.) |
| Total operating time (open or close) | 4 sec. |
| Control voltages | 48V. dc, 125V. dc and 250V. dc |

The device of the present invention is capable of switching load-magnetizing, charging and fault currents. The fault-current capability is limited, at the present time, to 10,000 amps. This device is also suitable for switching capacitor banks and reactors. Tables I, II, and III list the results of the tests performed on a single-pole prototype of the circuit protectors 350 switching fault currents, capacitor banks, and magnetizing currents respectively. Shorttime current ratings are 61,000 amps. momentary, and 40,000 amps. at 4 seconds. Results of these tests are shown in Table VI. Fault-closing rating is 40,000 amps., and the rated current is 1,200 amps. The voltage rating of the circuit protector, are, currently, 69 KV, 115 KV, 138 KV and 161 KV.

With reference to Table I, which shows shortcircuit current-interrupting test, it will be noted that the recovery voltage in kilovolts is indicated in the left-hand column, the symmetrical current is indicated in thousands of amperes in the second column, the asymmetrical current in kiloamperes is indicated in the third column, the transient recovery voltage is indicated in the fourth column in kilovolts per micro-second. All interruptions were completed within five cycles.

With reference to Table II, which sets forth the results in capacitor testing, the capacitance current is indicated in column 1, the test circuit voltage in kilovolts in the closed and open-circuit positions of the switch is indicated in columns 2 and 3.

The last column in Tables I and II relate to initiating the opening operation of the switch in electrical degrees along the sinusoidal alternating-current wave. The test equipment had, of course, facility of varying the position of tripping the switch.

Table III shows the capability of the switch in opening magnetizing currents of unloaded transformers. Again column 1 indicates the magnetizing current in amperes (RMS), column 2 indicates the recovery voltage in kilovolts, and the notes of column 3 indicate again the varying electrical position of initiating the opening operation of the switch.

Table IV shows the capability of the switch to carry the short-circuit currents when in the closed-circuit position.

TABLE I

| Recovery Voltage (KV) | Symmetrical Current (RMS KA) | Asymmetrical Current (RMS KA) | TRV (1-COS) (KV/μSec.) | Notes |
|---|---|---|---|---|
| 132 | 6 | 5.7-(Arc Time in miliseconds) | | |
| 132 | 6 | & 5.9 | | |
| 132 | 8 | 14.4 | 1.57 | |
| 132 | 10 | 14.4 | 1.74 | |
| 132 | 10 | 14.1 | 1.76 | |
| 132 | 10 | 12.8 | 1.72 | 30° Later Trip |
| 132 | 10 | 11.4 | 1.72 | 30° Later Trip |
| 132 | 10 | 9.7 | 1.67 | 30° Later Trip |
| 132 | 10 | 8.6 | 1.67 | 30° Later Trip |
| 132 | 10 | 7.2 | 1.69 | 30° Later Trip |
| 132 | 10 | 22.4 | 1.70 | 30° Later Trip |
| 132 | 10 | 12.0 | 1.71 | 30° Later Trip |
| 132 | 10 | 11.4 | 1.74 | 30° Later Trip |
| 132 | 10 | 9.9 | 1.74 | 30° Later Trip |
| 129 | 10 | 15.5 | 12 | 90° Earlier Trip<br>90° Earlier Cl.Sw. |
| 130 | 10 | 15.1 | 13.2 | 360° Earlier Trip |
| 129 | 10 | 7.0 | 14 | 180° Earlier Trip |
| 128 | 10 | 9.2 | 14.6 | 42° Earlier Trip |
| 135 | 10 | | 14.3 | Same Timing |
| 128 | 10 | 9.5 | 14.6 | Same Timing |
| 128 | 10 | 13.3 | 14.6 | 90° Earlier Trip |
| 128 | 10 | 1.8 | 16.7 | 90° Earlier Trip |
| 128 | 10 | 3.7 | 16 | 42° Later Trip |
| 128 | 10 | 14.1 | 16 | 42° Later Trip |
| 128 | 10 | 13.8 | 16 | 180° Later Trip<br>180° Later CL. Sw. |

TABLE II

| Capacitance Current (RMS Amperes) | Test Circuit Voltage(KV) Closed | Open | Notes |
|---|---|---|---|
| 550 | 114 | 91 | |
| 550 | 112 | 87.5 | 30° Later Trip |
| 550 | 112 | 87.5 | 30° Later Trip |
| 550 | 112 | 87.5 | 30° Later Trip |
| 550 | 112 | 87.5 | 30° Later Trip |
| 550 | 119 | 94 | 30° Later Trip |
| 550 | 119 | 94 | 30° Later Trip |
| 550 | 112 | 87.5 | 30° Later Trip |
| 280 | 57.5 | 45 | Same Timing- ½ Excitation |
| 550 | 112 | 87.5 | Same Timing |
| 550 | 112 | 87.5 | 30° Later Trip |
| 550 | 112 | 87.5 | 30° Later Trip |
| 550 | 112 | 87.5 | 30° Later Trip |
| 550 | 112 | 87.5 | 30° Later Trip |
| 550 | 112 | 87.5 | 30° Later Trip |
| 550 | 122 | 95 | Start of 161KV Tests |
| 550 | 125 | 100 | Repeat - Same Timing |
| 550 | 125 | 100 | 30° Later Trip |
| 550 | 125 | 100 | 30° Later Trip |
| 550 | 131 | 102 | 30° Later Trip |
| 550 | 131 | 102 | 30° Later Trip |
| 550 | 131 | 102 | 30° Later Trip |
| 550 | 135 | 105 | 30° Later Trip |
| 550 | 135 | 105 | 30° Later Trip |
| 550 | 135 | 105 | 30° Later Trip |
| 550 | 131 | 102 | 30° Later Trip |
| 550 | 134 | 100 | 30° Later Trip |
| 550 | 132 | 100 | 30° Later Trip |
| 550 | 132 | 100 | 30° Later Trip |
| 550 | 135 | 100 | Reverse Leads |

TABLE II-continued

| Capacitance Current (RMS Amperes) | Test Circuit Voltage(KV) Closed | Open | Notes |
|---|---|---|---|
| 550 | 132 | 100 | 30° Later Trip |
| 550 | 132 | 100 | 30° Later Trip |
| 550 | 135 | 100 | 30° Later Trip |
| 550 | 132 | 100 | 30° Later Trip |
| 550 | 132 | 100 | 30° Later Trip |
| 550 | 135 | 100 | 30° Later Trip |
| 550 | 132 | 100 | 30° Later Trip |
| 550 | 128 | 100 | 30° Later Trip |
| 550 | 132 | 100 | 30° Later Trip |
| 550 | 128 | 100 | 30° Later Trip |
| 550 | 135 | 100 | 30° Later Trip |
| 550 | 135 | 100 | 30° Later Trip |
| 350 | 68.5 | 53.5 | ½ Excitation - Back to Back |
| 750 | 169 | 122 | Full Excitation |
| 650 | 138 | 103 | 30° Later Trip |
| 650 | 132 | 100 | 30° Later Trip |
| 640 | 135 | 100 | 30° Later Trip |
| 640 | 132 | 100 | 30° Later Trip |
| 640 | 132 | 100 | 30° Later Trip |
| 640 | 132 | 100 | 30° Later Trip |
| 640 | 132 | 100 | 30° Later Trip |
| 640 | 132 | 100 | 30° Later Trip |
| 640 | 132 | 100 | 30° Later Trip |
| 650 | 133 | 102 | 30° Later Trip |
| 650 | 132 | 100 | 30° Later Trip |
| 650 | 131 | 100 | 30° Later Trip |
| 650 | 131 | 100 | Reverse Leads |
| 650 | 131 | 100 | Reverse Leads |
| 290 | 65 | 50 | 30° Later Trip |
| 580 | 129 | 100 | ½ Excitation 30° Later Trip |
| 560 | 125 | 100 | Full Excitation Same Timing |
| 580 | 123 | 100 | 30° Later Trip |
| 600 | 125 | 100 | 30° Later Trip |
| 600 | 130 | 100 | 30° Later Trip |
| 600 | 130 | 100 | 30° Later Trip |
| 600 | 130 | 100 | 30° Later Trip |
| 640 | 131 | 100 | 30° Later Trip |
| 640 | 131 | 100 | 30° Later Trip |
| 640 | 131 | 100 | 30° Later Trip |
| 620 | 135 | 100 | 30° Later Trip |

TABLE III

| Magnetizing Current (RMS Amperes) | Recovery Voltage (KV) | Notes |
|---|---|---|
| 1.1 | 144 | |
| 1.3 | 132 | .08 Cycle Earlier Trip |
| 1.4 | 147 | .08 Cycle Earlier Trip |
| 1.1 | 146 | .1 Cycle Earlier Trip |
| 1.1 | 147 | .08 Cycle Earlier Trip |
| 1.1 | 144 | .08 Cycle Earlier Trip |
| 1.1 | 147 | .1 Cycle Earlier Trip |
| .8 | 72 | Changed Reactor in Attempt to get 3 Amperes. |
| 1.6 | 147 | " |
| 1.6 | 144 | " |
| 1.6 | 147 | " |
| 1 | 72 | New Transformer Setting ½ Excitation |
| 4.9 | 135 | Full Excitation |
| 3 | 117 | |
| 3 | 114 | .1 Cycle Later Trip |
| 3 | 117 | .08 cycle Later Trip |
| 3 | 117 | .08 Cycle Later Trip |
| 3 | 117 | .1 Cycle Later Trip |
| 3 | 117 | .08 Cycle Later Trip |
| 3 | 117 | .08 Cycle Later Trip |
| 5 | 129 | |
| 6 | 132 | |
| 6 | 132 | .08 Cycle Earlier Trip |
| 6 | 132 | .08 Cycle Earlier Trip |
| 6 | 132 | .1 Cycle Earlier Trip |

TABLE IV

| Current (KA) | Type of Test | Notes |
|---|---|---|
| 45 | Momentary | Interrupter Tripped after Test |
| 67.5 | Momentary | Interrupter Tripped after Test |
| 43.5 | 3 Second | Interrupter Tripped |

TABLE IV-continued

| Current (KA) | Type of Test | Notes |
|---|---|---|
| | | after Test |
| 43.5 | 4 Second | Only 3 Sec. of Current |
| | | Interrupter Tripped after Test |
| 42.3 | 4 Seconds | Interrupter Tripped |

TABLE IV-continued

| Current (KA) | Type of Test | Notes |
|---|---|---|
| | | after Test |

From the foregoing, it will be apparent that the improved advantageous features of the improved puffer-type interrupter may be utilized in connection with electrical equipment in which a serially-related disconnecting switchblade is not desired, or for safety reasons is not needed in the particular application.

Although there have been illustrated and described specific structures, it is to be clearly understood that the same were merely for the purpose of illustration, and that changes and modifications may readily be made therein by those skilled in the art without departing from the spirit and scope of the invention.

I claim:

1. A puffer-type gas-blast circuit-interrupter including an elongated hollow insulating casing means (32), a first metallic end-plate member (163) closing one open end of said hollow insulating casing means (32), a tubular elongated relative-stationary venting contact, relatively stationary contact-supporting metallic means mounted upon the inner side of said metallic end-plate member (163) and supporting said relatively-stationary tubular venting contact by a lost-motion connection, said metallic supporting means for said tubular elongated relatively-stationary venting contact (150) being disposed rearwardly from the forward contacting tip of said venting contact (150), contact-biasing means (179) associated with said contact-supporting means and biasing said relatively-stationary tubular venting contact in a direction toward the interior of said elongated hollow insulating casing means (32), a movable operating cylinder-assembly comprising an axially-extending hollow insulating nozzle (157) and a tubular elongated venting movable contact making contacting valve-like abutment engagement with said relatively-stationary tubular venting contact in the closed-circuit position of the circuit-interrupter, a second metallic end-plate member (164) closing the other open end of said hollow insulating casing means (32), means defining a fixed piston member located intermediate the ends of said hollow insulating casing means over which said movable operating cylinder-assembly operatively slides during the opening operation to thereby compress gas therewithin, supporting means affixed to the inner side of said second metallic end-plate member (164) and extending interiorly of said hollow insulating casing means to fixedly support therein said fixed piston member, said axially-extending hollow insulating nozzle (157) surrounding said relatively-stationary tubular venting contact in the closed-circuit position of the circuit-interrupter, means defining an annular apertured metallic cooler-member (56) disposed entirely interiorly of said hollow insulating nozzle (157) so as not to project externally up to the surface of said movable operating cyclinder-assembly, said stationary and movable venting contacts being separable to establish an arc during a circuit-interrupter opening operation, said annular apertured metallic cooler member being closely located to the contact tip of the movable tubular venting elongated contact so as thereby to cool the compressed gas ejected from the interior of said movable operating cylinder through said hollow nozzle and axially along said drawn arc, the abutting contacting engagement between the stationary and movable venting contacts during the opening operation of the circuit-interrupter and also during the time of take-up of the lost-motion travel for the stationary venting contact providing a desirable valve-closed action to thereby retain and build up gas pressure during the compression phase within said movable operating cylinder until a predetermined time, coincident with the take-up of said lost-motion, whereupon contact separation between the stationary and movable venting contacts occurs and only then compressed gas ejection takes place through the hollow movable insulating nozzle for arc-extinction purposes therein, supporting means affixed to the inner side of the second metallic-end-plate member (164) including longitudinally-extending guide rail means, and a lazy-tong multiplying operating mechanism disposed internally of said casing means and guided by said guide rail means to provide a very fast opening and closing motion of the movable operating cylinder and the movable venting contact movable therewith.

2. The combination according to claim 1, wherein at least a pair of angle-standards are utilized by said guide rail means to form a raceway for the roller structure constituting a part of the lazy-tong multiplying operating mechanism.

3. The combination according to claim 2, wherein four angle-standards are supported by said guide rail means to provide a pair of raceways for the roller structure associated with the laxy-tong multiplying operating mechanism.

4. The combination according to claim 1, wherein a pair of serially-related operating rods are provided, and a lazy-tong multiplying mechanism is interposed between said two serially-related operating rods for quickly effecting opening and closing motions of the movable venting contact and the movable operating cyclinder-assembly.

* * * * *